US008598097B2

(12) United States Patent
Artman et al.

(10) Patent No.: US 8,598,097 B2
(45) Date of Patent: Dec. 3, 2013

(54) DIESEL LUBRICANT LOW IN SULFUR AND PHOSPHORUS

(75) Inventors: Diane M. Artman, Westlake, OH (US); William D. Abraham, Concord Township, Lake County, OH (US); Virginia A. Carrick, Chardon, OH (US); Jonathan S. Vilardo, Willoughby, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 678 days.

(21) Appl. No.: 10/554,481

(22) PCT Filed: Apr. 20, 2004

(86) PCT No.: PCT/US2004/012169

§ 371 (c)(1),
(2), (4) Date: Oct. 24, 2005

(87) PCT Pub. No.: WO2004/096957

PCT Pub. Date: Nov. 11, 2004

(65) Prior Publication Data

US 2006/0205614 A1 Sep. 14, 2006

Related U.S. Application Data

(60) Provisional application No. 60/465,072, filed on Apr. 24, 2003.

(51) Int. Cl.
*C10M 169/04* (2006.01)

(52) U.S. Cl.
USPC ..... 508/110; 508/287; 508/391; 508/567

(58) Field of Classification Search
USPC ..... 508/278, 110, 287, 391, 567
See application file for complete search history.

(56) References Cited

U.S. PATENT DOCUMENTS

| | | | | | |
|---|---|---|---|---|---|
| 2,227,692 | A | | 1/1941 | Barnard | |
| 2,937,992 | A | | 5/1960 | Kleinholz | |
| 3,791,985 | A | * | 2/1974 | Schenck et al. | 508/432 |
| 3,090,425 | A | | 9/1975 | Crawdord et al. | |
| 4,582,618 | A | * | 4/1986 | Davis | 508/338 |
| 4,960,528 | A | | 10/1990 | Everett et al. | |
| 5,006,271 | A | | 4/1991 | Avery et al. | |
| 5,102,566 | A | * | 4/1992 | Fetterman et al. | 508/294 |
| 5,719,107 | A | | 2/1998 | Outten et al. | |
| 5,804,537 | A | * | 9/1998 | Boffa et al. | 508/398 |
| 5,840,672 | A | * | 11/1998 | Gatto | 510/376 |
| 5,912,212 | A | * | 6/1999 | Igarashi et al. | 508/275 |
| 6,362,136 | B1 | * | 3/2002 | Richardson et al. | 508/186 |
| 6,559,105 | B2 | | 5/2003 | Abraham et al. | 508/186 |
| 2002/0058593 | A1 | * | 5/2002 | Bovington et al. | 508/192 |
| 2002/0147116 | A1 | | 10/2002 | Lamb et al. | |
| 2003/0166477 | A1 | | 9/2003 | Abraham et al. | |
| 2003/0216266 | A1 | * | 11/2003 | Hirano et al. | 508/291 |
| 2003/0220209 | A1 | * | 11/2003 | Curtis et al. | 508/551 |
| 2004/0129603 | A1 | * | 7/2004 | Fyfe et al. | 208/18 |

FOREIGN PATENT DOCUMENTS

| | | | | |
|---|---|---|---|---|
| EP | 1 266952 | | | 12/2002 |
| JP | 63 061090 | | | 3/1998 |
| JP | 2002053888 | A | * | 2/2002 |
| JP | 2004035882 | A | * | 2/2004 |
| WO | 03/022963 | | | 3/2003 |
| WO | 03/104620 | | | 12/2003 |

* cited by examiner

*Primary Examiner* — Taiwo Oladapo
(74) *Attorney, Agent, or Firm* — David M. Shold; Teresan W. Gilbert

(57) ABSTRACT

A low-sulfur, low-phosphorus composition comprising an oil of lubricating viscosity; a substantially nitrogen-free sufurized olefin antiwear agent; a nitrogen-containing dispersant; and an overbased detergent selected from the group consisting of salixarates, saligenins, salicylates, and glyoxylates; containing less than about 0.1 percent by weight phosphorus, less than about 0.5 percent by weight sulfur, and having less than about 1.2% sulfated ash, is useful for lubricating a diesel engine, exhibiting good antiwear performance.

20 Claims, No Drawings

DIESEL LUBRICANT LOW IN SULFUR AND PHOSPHORUS

This application claims priority from U.S. Provisional Application Ser. No. 60/465,072, filed Apr. 24, 2003.

BACKGROUND OF THE INVENTION

The present invention relates to a lubricant particularly suitable for lubricating internal combustion engines.

For many years, zinc dialkyldithiophosphates (ZDPs) have been used in engine lubricants to provide antiwear and antioxidant performance. Despite their excellent history of performance benefits, these materials do contribute sulfur and phosphorus content to lubricating oils. Recently environmental and other requirements have placed increasingly stringent limits on the amount of sulfur and phosphorus that can be contained in engine lubricants. One possible response to this demand is to reduce the amount of ZDP and other sulfur- or phosphorus-containing additives such as sulfurized olefins and sulfur-containing detergents in the lubricants. Not unexpectedly, this approach has led to worsening of exactly those properties that ZDP and other such materials were originally added to improve. Performance areas which are particularly severely affected include antiwear performance of the injector adjustor screw, as measured by the "Short Cummins M11 Engine Test," as well as performance in the Cummins M11 Engine Test and the Cummins M11 Test.

To improve the antiwear performance of such formulations while maintaining acceptably low sulfur and phosphorus levels has been a significant technical challenge. Although small amounts of sulfur- or phosphorus-containing compounds may be added if they impart significant benefits, the amount employed must not be so great as to raise the amounts of S or P to unacceptable levels. It is also desirable that the lubricant formulation will be low metal-containing ash (less than 1.2% or 1% sulfated ash by ASTM D 874, preferably less than 0.8%, 0.6%, or 0.5%), so preferably any additive will contribute little or no sulfated ash. (If desired, the lubricant may also have a small level of sulfated ash, e.g., 0.1%, 0.2%, 0.3%, 0.4%, or 0.5%.)

Various approaches to lubricating internal combustion engines are known. U.S. Pat. No. 4,582,618, Davis, Dec. 14, 1984, discloses low phos- phorus- and sulfur-containing lubricating oils, containing less than about 0.1% wt. phosphorus, more generally less than about 0.08%. A sulfurized Diels-Alder adduct can also be present. Such compositions are said to exhibit improved antiwear properties.

U.S. Pat. No. 5,006,271 Avery et al., Apr. 9, 1991, discloses sulfurized propylene based lube olefin derivatives. Fully formulated lubricating oils may contain a variety of other additives. Examples include 1% of a sulfurized propylene based lube olefin in a standard test mineral oil.

U.S. Pat. No. 5,719,107, Outten et al., Feb. 17, 1998, discloses crankcase lubricants for heavy duty diesel, containing at least 4 mass % dispersant, at least 0.3 mass % metal phenate, less than 0.1 mass % friction modifier, less than 0.3 mass % sulfurized phenols, and less than 0.12 mass % neutral calcium sulfonate. Oxidation inhibitors include sulfurized hydrocarbons.

U.S. Pat. No. 2,227,692, Barnard, Jan. 7, 1941, discloses oils for lubricating diesel engines, which includes a small amount of sulfur or a sulfurized mineral oil.

The present invention solves the problem of providing a low sulfur, low phosphorus, low ash lubricant which exhibits good antiwear performance, by including in the formulation a minor amount of a sulfurized olefin.

SUMMARY OF THE INVENTION

The present invention, therefore, provides a process for lubricating a sump lubricated, compression ignited internal combustion engine, comprising supplying thereto a low-sulfur, low-phosphorus lubricant comprising: (a) an oil of lubricating viscosity; (b) a substantially nitrogen-free sulfurized olefin antiwear agent in an amount sufficient to provide improved antiwear performance to the composition; and (c) about 1 to about 10 percent by weight of a nitrogen-containing dispersant; said lubricant formulation containing less than about 0.1 percent by weight phosphorus, less than about 0.4 percent by weight sulfur, and having less than about 1.2% sulfated ash.

The present invention also provides a low-sulfur, low-phosphorus composition suitable for lubricating a compression ignited internal combustion engine, comprising: (a) an oil of lubricating viscosity; (b) a substantially nitrogen-free sulfurized olefin antiwear agent, in an amount sufficient to provide improved antiwear performance to the composition; (c) 1 to 10 percent by weight of a nitrogen-containing dispersant; and (d) an overbased detergent selected from the group consisting of salixarates, saligenins, salicylates, glyoxylates, and mixtures thereof; said composition containing less than 0.1 percent by weight phosphorus, less than 0.4 percent by weight sulfur, and having less than 1.2% sulfated ash (ASTM D 874).

The invention also provides for a concentrate of the above formulation in a concentrate-forming amount of oil of lubricating viscosity, in which each of the amounts of the components other that (a) referred to above is increased by a factor of approximately 10, that is, (a) about 20 to about 60 percent by weight of an oil of lubricating viscosity; (b) about 0.5 to about 15 percent by weight of a substantially nitrogen-free sulfurized olefin antiwear agent; (c) about 1 to about 40 percent by weight of a nitrogen-containing dispersant; and (d) an overbased detergent selected from the group consisting of salixarates, saligenins, salicylates, glyoxylates, and mixtures thereof; said concentrate containing less than about 1.2 percent by weight phosphorus, less than about 5 percent by weight sulfur, and having less than about 15% sulfated ash.

DETAILED DESCRIPTION OF THE INVENTION

Various preferred features and embodiments will be described below by way of non-limiting illustration.

The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates(%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof.

Alkylene oxide polymers and interpolymers and derivatives thereof, and those where terminal hydroxyl groups have been modified by, for example, esterification or etherification, constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyol ethers.

Other synthetic lubricating oils include liquid esters of phosphorus-containing acids, polymeric tetrahydrofurans, silicon-based oils such as the poly-alkyl-, polyaryl-, polyalkoxy-, or polyaryloxy-siloxane oils, and silicate oils.

Hydrotreated naphthenic oils are also known and can be used, as well as oils prepared by a Fischer-Tropsch gas-to-liquid synthetic procedure.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The lubricating oil in the invention, when present in a concentrate-forming amount, will often comprise the major amount of the composition. Thus it will normally be at 20 to 60% by weight of the composition, alternatively 25 to 50%. The oil can comprise the balance of the composition after accounting for component (b) described in further detail below, as well as any additional or optional additives. In a fully formulated lubricant, the amount of the oil will typically be 75 to 98% by weight, preferably 80 to 95% or 83 to 93%.

The term "base oil" is sometimes used to include not only the oil itself but also viscosity modifiers or pour point depressants, which are typically polymeric materials added to affect the high and low temperature properties of the oil. As used herein, the term "oil of lubricating viscosity" is not intended to include viscosity modifier or pour point depressant, which materials will be accounted for separately. However, when amounts of oil of lubricating viscosity are reported, they do include amounts of diluent oil traditionally included with many additives as commercially supplied.

Sulfurized olefins are well known commercial materials, and those which are substantially nitrogen-free, that is, not containing nitrogen functionality, are readily available. The olefinic compounds which may be sulfurized are diverse in nature. They contain at least one olefinic double bond, which is defined as a non-aromatic double bond; that is, one connecting two aliphatic carbon atoms. In its broadest sense, the olefin may be defined by the formula $R^{*1}R^{*2}C{=}CR^{*3}R^{*4}$, wherein each of $R^{*1}$, $R^{*2}$, $R^{*3}$ and $R^{*4}$ is hydrogen or an organic group. In general, the $R^*$ groups in the above formula which are not hydrogen may be satisfied by such groups as $-C(R^{*5})_3$, $-COOR^{*5}$, $-COOM$, $-X$, $-YR^{*5}$ or $-Ar$, wherein each $R^{*5}$ is independently hydrogen, alkyl, alkenyl, aryl, substituted alkyl, substituted alkenyl or substituted aryl, with the proviso that any two $R^{*5}$ groups can be alkylene or substituted alkylene whereby a ring of up to 12 carbon atoms is formed; M is one equivalent of a metal cation (preferably Group I or II, e.g., sodium, potassium, barium, calcium); X is halogen (e.g., chloro, bromo, or iodo); Y is oxygen or divalent sulfur; Ar is an aryl or substituted aryl group of up to 12 carbon atoms. Any two of $R^{*1}$, $R^{*2}$, $R^{*3}$ and $R^{*4}$ may also together form an alkylene or substituted alkylene group; i.e., the olefinic compound may be alicyclic.

One type of sulfurized olefin is prepared in accordance with the detailed teachings of U.S. Pat. No. 4,957,651. Described therein is a cosulfurized mixture of 2 or more reactants selected from the group consisting of (1) at least one fatty acid ester of a polyhydric alcohol, (2) at least one fatty acid, (3) at least one olefin, and (4) at least one fatty acid ester of a monohydric alcohol. Reactant (3), the olefin component, comprises at least one olefin. This olefin is preferably an aliphatic olefin, which usually will contain 4 to 40 carbon atoms, preferably from 8 to 36 or 12 to 18 carbon atoms. Terminal olefins, or alpha-olefins, are preferred, especially those having from 12 to 20 carbon atoms. Mixtures of these olefins are commercially available, and such mixtures are contemplated for use in this invention.

The sulfurized olefin can be prepared by reacting a single reactant or a mixture of appropriate reactants with a source of sulfur. The sulfurization reaction generally is effected at an elevated temperature, e.g., 50-350° C. or 100-200° C., with efficient agitation and often in an inert atmosphere such as nitrogen, optionally in the presence of an inert solvent. The sulfurizing agents useful in the process of the present invention include elemental sulfur, which is preferred, hydrogen sulfide, sulfur halide, sodium sulfide and a mixture of hydrogen sulfide and sulfur or sulfur dioxide. Usually, the amount of sulfur or sulfurizing agent employed calculated based on the total olefinic unsaturation of the mixture. Typically often 0.5 to 3 moles of sulfur are employed per mole of olefinic bonds.

The olefinic compound is usually one in which each R group, above, which is not hydrogen is independently alkyl, alkenyl or aryl group. Monoolefinic and diolefinic compounds, particularly the former, are preferred, and especially terminal monoolefinic hydrocarbons; that is, those compounds in which $R^{*3}$ and $R^{*4}$ are hydrogen and $R^{*1}$ and $R^{*2}$ are alkyl or aryl, especially alkyl (that is, the olefin is aliphatic) having 1 to 30, or 1 to 16, or 1 to 8, or 1 to 4 carbon atoms. Olefinic compounds having 3 to 30 or 3 to 16 (often fewer than 9) carbon atoms can be used.

Isobutene, propylene and their dimers, trimers and tetramers, and mixtures thereof are useful as olefinic compounds for sulfurization, as are terpene compounds, that is, various isomeric terpene hydrocarbons having the empirical formula $C_{10}H_{16}$, as well as various synthetic and naturally occurring oxygen-containing derivatives thereof.

In one embodiment, the sulfurized organic composition is a sulfur-containing material which comprises the reaction product of a sulfur source and at least one Diels-Alder adduct, in a molar ratio of at least 0.75:1. Generally, the molar ratio of sulfur source to Diels-Alder adduct is 0.75 to 4.0, or 1 to 2.0, or 1 to 1.8. The Diels-Alder adducts can be prepared from dienophiles having at least one carboxylic ester group represented by —C(O)O—$R_o$ where $R_o$ is the residue of a saturated aliphatic alcohol of up to 40 carbon atoms, the aliphatic alcohol from which —$R_o$ is derived being a mono or polyhydric alcohol such as alkylene glycols, alkanols, aminoalkanols, alkoxy-substituted alkanols, ethanol, ethoxy ethanol, propanol, butanol, beta-diethylamino-ethanol, dodecyl alcohol, diethylene glycol, tripropylene glycol, tetrabutylene glycol, hexanol, octanol, and isooctyl alcohol. Generally not more than two —C(O)—O—$R_o$ groups will be present, preferably only one —C(O)—O—$R_o$ group. Such materials can also be described as cyclohexene compounds bearing ester substituents. A preferred sulfurized olefin is sulfurized 4-carbobutoxy cyclohexene. This and other sulfurized olefins can be further treated with other materials such as an aryl phosphate, e.g., triphenyl phosphite.

Other sulfurized olefins include sulfurized vegetable oils and sulfurized lard oil (that is, sulfurized oils of animal sources generally).

The amount of the sulfurized olefin in a fully formulated lubricant will be an amount sufficient to improved the anti-wear performance of the lubricant, as measured by any well-known wear tests, as described below. Such an amount will typically be 0.05 to 1.5% or to 1% by weight, preferably 0.10 to 0.80% or 0.15 to 0.70% or 0.20 to 0.60%. In a concentrate the amounts will be approximately an order of magnitude greater, e.g., 0.5 to 15% or to 10% by weight. A concentration of 0.5% sulfurized 4-carbobutoxy cyclohexene will typically impart about 580 ppm by weight sulfur to the lubricant, which is consistent with a low-sulfur composition. (The present specification that the composition contain less than 0.4 or 0.35 percent S, or less than 0.3 percent S, or alternatively less than 0.27 percent S, is determined based on the total sulfur from all sources, including the sulfurized olefin and, e.g., any sulfonates, sulfurized phenates, and dithiophosphates. The lubricant composition may also contain, for example, 0.05 or 0.1 to 0.4 or to 0.35 or to 0.3 or to 0.27 weight percent total sulfur.)

Other materials will normally be present in the lubricant in order to provide a better balance of performance properties, while retaining low concentrations of sulfur, phosphorus, and sulfated ash. One such material which is typically present is a nitrogen-containing dispersant. Dispersants are well known in the field of lubricants and include primarily what are sometimes referred to as ashless-type dispersants and polymeric dispersants. Ashless type dispersants are so-called because, as supplied, they do not contain metal and thus do not normally contribute to sulfated ash when added to a lubricant. However they may, of course, interact with ambient metals once they are added to a lubricant which includes metal-containing species. These materials are characterized by a polar group attached to a relatively high molecular weight hydrocarbon chain. Typical ashless dispersants include N-substituted long chain alkenyl succinimides (succinimide dispersants), having a variety of chemical structures including typically

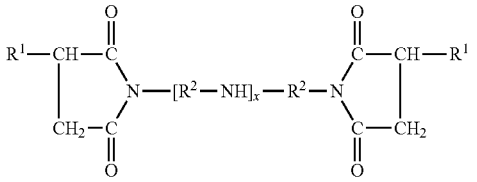

where each $R^1$ is independently an alkyl or alkenyl group, optionally substituted with additional succinimide groups, frequently a polyisobutyl group with a molecular weight of 500-5000, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Other types of linkages to the $R^1$ are also possible. Succinimide dispersants are more fully described in U.S. Pat. Nos. 4,234,435 and 3,172,892.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Such materials may be nitrogen-containing dispersants if one of the components, e.g., the alcohol component, also contains a nitrogen atom. One such alcohol component is trihydroxymethylaminomethane ("THAM")

Another class of nitrogen-containing ashless dispersant is Mannich bases. These are materials which are formed by the condensation of a higher molecular weight, alkyl substituted phenol, an alkylene polyamine, and an aldehyde such as formaldehyde. Such materials may have the general structure

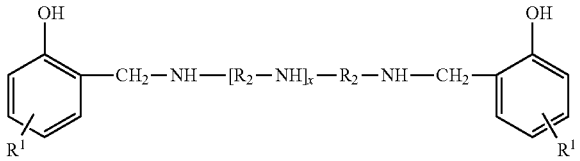

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitrites, epoxides, boron compounds, and phosphorus compounds. References detailing such treatment are listed in U.S. Pat. No. 4,654,403.

The amount of the dispersant in a fully formulated lubricant will typically be 1 to 10 percent by weight, alternatively 2.0 to 8.5 percent by weight, 2.5 to 8.0 percent, or 3.0 to 7.0 percent. In a concentrate the amount will typically be significantly higher, e.g., 1 to 40 percent, 5 to 35 percent, or 10 to 30 percent by weight.

The lubricant formulation will also typically contain one or more metal-containing detergents, restricted, however, to an amount which does not provide an excessive amount of sulfated ash to the composition. Metal-containing detergents are typically overbased materials, or overbased detergents. Overbased materials, otherwise referred to as overbased or superbased salts, are generally homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (e.g., mineral oil, naphtha, toluene, xylene) for said acidic organic material, a stoichiometric excess of a metal base, and a promoter such as a phenol or alcohol and optionally ammonia. The acidic organic material will normally have a sufficient number of carbon atoms, for instance, as a hydrocarbyl substituent, to provide a reasonable degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

The metal compounds useful in making the basic metal salts are generally any Group 1 or Group 2 metal compounds (CAS version of the Periodic Table of the Elements). The Group 1 metals of the metal compound include Group 1a alkali metals such as sodium, potassium, and lithium, as well as Group 1b metals such as copper. The Group 1 metals are preferably sodium, potassium, lithium and copper, more preferably sodium or potassium, and more preferably sodium. The Group 2 metals of the metal base include the Group 2a alkaline earth metals such as magnesium, calcium, and barium, as well as the Group 2b metals such as zinc or cadmium. Preferably the Group 2 metals are magnesium, calcium, barium, or zinc, preferably magnesium or calcium, more preferably calcium. Generally the metal compounds are delivered as metal salts. The anionic portion of the salt can be hydroxide, oxide, carbonate, borate, or nitrate.

Such overbased materials are well known to those skilled in the art. Patents describing techniques for making basic salts of sulfonic acids, carboxylic acids, (hydrocarbyl-substituted) phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

In one embodiment the lubricants of the present invention can contain an overbased calcium sulfonate detergent of high total base number (TBN, expressed as mg KOH/g of overbased material, see for instance ASTM D 4739). A high TBN material is a material which has a high metal ratio. A typical high TBN calcium sulfonate can have a TBN of at least 300, e.g., 300 to 400, as determined in the presence of the amount of diluent oil customarily present with such salts (typically 40 to 50, e.g., 42 to 47 percent oil). If a high TBN overbased calcium sulfonate detergent is used, its amount in the composition can be 0.2 to 3% or 0.25 to 2.5% or 0.3 to 2.0%, expressed here on an oil-free basis.

Another overbased material which can be present is an overbased calcium phenate detergent. Such materials are often available as sulfur-bridged species, and it may also be desirable that such materials are substantially or entirely absent, in order to reduce the amount of sulfur contributed therefrom.

In one embodiment, the overbased material is an overbased detergent selected from the group consisting of overbased salixarate detergents, overbased saligenin detergents, overbased salicylate detergents, and overbased glyoxylate detergents, and mixtures thereof. Overbased saligenin detergents are commonly overbased magnesium salts which are based on saligenin derivatives. A general example of such a saligenin derivative can be represented by the formula

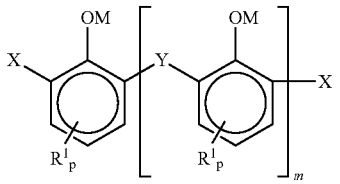

wherein X comprises —CHO or —$CH_2OH$, Y comprises —$CH_2$— or —$CH_2OCH_2$—, and wherein such —CHO groups typically comprise at least 10 mole percent of the X and Y groups; M is hydrogen, ammonium, or a valence of a metal ion, $R^1$ is a hydrocarbyl group containing 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen. Other metals include alkali metals such as lithium, sodium, or potassium; alkaline earth metals such as calcium or barium; and other metals such as copper, zinc, and tin.

As used herein, the expression "represented by the formula" indicates that the formula presented is generally representative of the structure of the chemical in question. However, it is well known that minor variations can occur, including in particular positional isomerization, that is, location of the X, Y, and R groups at different position on the aromatic ring from those shown in the structure. The expression "represented by the formula" is expressly intended to encompass such variations.

Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a substantially linear compound comprising at least one unit of formula (I) or formula (II):

(I)

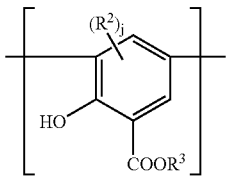

-continued (II)

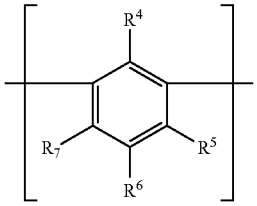

each end of the compound having a terminal group of formula (III) or formula (IV):

(III)

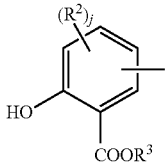

(IV)

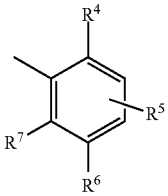

such groups being linked by divalent bridging groups A, which may be the same or different for each linkage; wherein in formulas (I)-(IV) $R^3$ is hydrogen or a hydrocarbyl group; $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is about 0.1:1 to about 2:1.

The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group having the general structure (V)

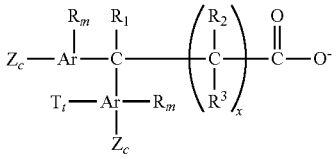

wherein T is selected from the group consisting of (VI)

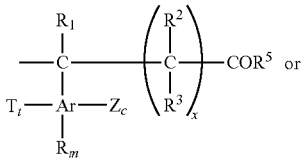

(VII)

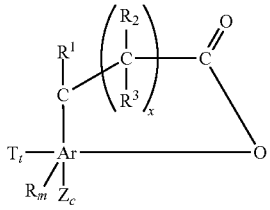

wherein each $R^5$ is independently selected from $O^-$ and $OR^6$ wherein $R^6$ is H or alkyl and each t is independently 0 or 1, wherein each Ar is independently an aromatic group of from 4 to about 30 carbon atoms having from 0 to 3 optional substituents selected from the group consisting of polyalkoxyalkyl, lower alkoxy, nitro, halo or combinations of two or more of said optional substituents, or an analog of such an aromatic nucleus, each R is independently alkyl, alkenyl or aryl containing at least 8 carbon atoms, $R^1$ is H or a hydrocarbyl group, $R^2$ and $R^3$ are each independently H or a hydrocarbyl group, each m is independently an integer ranging from 1 to 10, x ranges from 0 to 6, and each Z is independently OH, $(OR^4)_bOH$, or $O^-$ wherein each $R^4$ is independently a divalent hydrocarbyl group and b is a number ranging from 1 to 30 and c ranges from 0 to 3 with the proviso that when t in Formula (V)=0, or when T is Formula (VI), then c is not 0, provided that the sum of m, c and t does not exceed the unsatisfied valences of the corresponding Ar. The aromatic group Ar of formula (V) can be a single aromatic nucleus such as a benzene nucleus, a pyridine nucleus, a thiophene nucleus, a 1,2,3,4-tetrahydronaphthalene nucleus, or a polynuclear aromatic moiety.

More specific examples of the anionic moieties present in glyoxylate detergents include

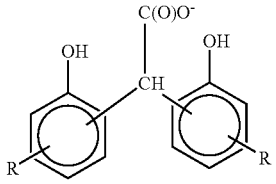

and more specifically,

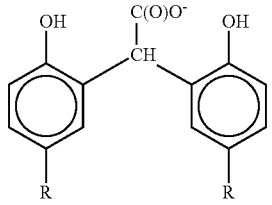

wherein each R is independently an alkyl group containing at least 4, and preferably at least 8 carbon atoms, provided that the total number of carbon atoms in all such R groups is at least 12, preferably at least 16 or 24. Alternatively, each R can be an olefin polymer substituent.

The acidic material upon from which the overbased glyoxylate detergent is prepared is the condensation product of a hydroxyaromatic material such as a hydrocarbyl-substituted phenol with a carboxylic reactant. Examples of the carboxylic reactant include glyoxylic acid and other omega-oxoalkanoic acids, keto alkanoic acids such as pyruvic acid, levulinic acid, ketovaleric acids, ketobutyric acids and numerous others. U.S. Pat. No. 2,933,520 (Bader) and U.S. Pat. No. 3,954,808 (Elliott et al) describe procedures for preparing the intermediate via reaction of phenol and such acids. The intermediate product obtained from the reaction of the foregoing hydroxy aromatic compounds and carboxylic acids is then reacted with a metal containing reactant to form a salt. Suitable metal containing reactants have been enumerated hereinabove. Overbased glyoxylic detergents and their methods of preparation are disclosed in greater detail in U.S. Pat. No. 6,310,011 and references cited therein.

The overbased detergent can also be an overbased salicylate. The salicylic acids preferably are hydrocarbyl-substituted salicylic acids, preferably aliphatic hydrocarbon-substituted salicylic acids wherein each substituent contains an average of at least 8 carbon atoms per substituent and 1 to 3 substituents per molecule. The substituents can be polyalkene substituents, where polyalkenes include homopolymers and interpolymers of polymerizable olefin monomers of 2 to about 16, preferably 2 to 6, or 2 to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the hydrocarbyl substituent group or groups on the salicylic acid contains 7 to 300 carbon atoms and can be an alkyl group having a molecular weight of 150 to 2000. The polyalkenes and polyalkyl groups are prepared by conventional procedures, and substitution of such groups onto salicylic acid can be effected by known methods. Overbased salicylate detergents and their methods of preparation are disclosed in U.S. Pat. Nos. 4,719,023 and 3,372,116.

Other overbased detergents include overbased detergents having a Mannich base structure as, disclosed in U.S. Pat. No. 6,569,818.

The amount of the overbased detergent, if present, can typically be 0.1 to 3 percent by weight, or 0.15 to 0.2 percent or 0.2 to 0.13 percent, or 0.4 to 0.8 percent.

A material which is optionally present is a metal salt of a phosphorus acid, including a thiophosphorus acid, in particular, metal salts of the formula

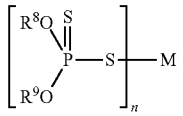

wherein $R^8$ and $R^9$ are independently hydrocarbyl groups containing 3 to 30 carbon atoms. These materials are readily obtainable by the reaction of phosphorus pentasulfide ($P_2S_3$) and an alcohol or phenol to form an O,O-dihydrocarbyl phosphorodithioic acid corresponding to the formula

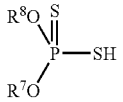

The reaction involves mixing at a temperature of 20° C. to 200° C. or 60 to 110° C., four moles of an alcohol or a phenol with one mole of phosphorus pentasulfide. Hydrogen sulfide is liberated in this reaction. The acid is then reacted with a basic metal compound to form the salt. The metal M, having a valence n, generally is tin, manganese, cobalt, nickel, zinc, or copper, and most preferably zinc. The basic metal compound is thus preferably zinc oxide, and the resulting metal compound is represented by the formula

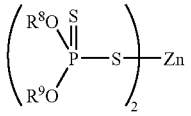

The $R^8$ and $R^9$ groups are independently hydrocarbyl groups that are preferably free from acetylenic and usually also from ethylenic unsaturation. They are typically alkyl, cycloalkyl, aralkyl or alkaryl group and have 3 to 20 carbon atoms, preferably 3 to 16 carbon atoms and most preferably up to 13 carbon atoms, e.g., 3 to 12 carbon atoms. The alcohol which reacts to provide the $R^8$ and $R^9$ groups can be a mixture of a secondary alcohol and a primary alcohol, for instance, preferably a mixture of isopropanol and 4-methyl-2-pentanol. In one embodiment, at least 50% of the alkyl groups (derived from the alcohol) in the dialkyldithiophosphate are secondary groups, that is, from secondary alcohols.

Such materials are the commercially well-known zinc dialkyldithiophosphates or simply zinc dithiophosphates (ZDPs).

The amount of the metal salt of a phosphorus acid in a completely formulated lubricant, if present, will typically be an amount to contribute 0.01 or 0.02 to 0.12% or to 0.10% or to 0.09% phosphorus to the composition, or 0.025 to 0.085%, or 0.03 to 0.08%, or 0.04 to 0.07% phosphorus. For a typical ZDP which may contain 10% P content, the actual amount of the ZDP would be 0.2 to 1.2% or to 1.0% or to 0.9%, and the correspondingly narrower ranges (0.25 to 0.85, 0.3 to 0.8, or 0.4 to 0.7 percent). Its concentration in a concentrate will be correspondingly increased by about a factor of 10 to, e.g., 2 to 12 or to 10 or to 9 weight percent. In one embodiment the metal salt of the phosphorus acid is substantially the only source of phosphorus in the lubricant. In one embodiment the total amount of phosphorus in the lubricant from all sources is as described above, that is, 0.01 or 0.02 to 0.12 or to 0.10 or to 0.09 percent by weight, or 0.025 to 0.085 or 0.03 to 0.08 or 0.04 to 0.07 percent.

Another material which is typically present is one or more antioxidants, especially phenolic or aromatic amine antioxidants. Antioxidants for use in lubricant compositions are well known and include a variety of chemical types including phenate sulfides, phosphosulfurized terpenes, sulfurized esters, aromatic amines, and hindered phenols.

Aromatic amines are typically of the formula

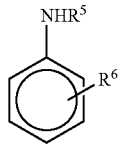

wherein $R^5$ is a phenyl group or a phenyl group substituted by $R^7$, and $R^6$ and $R^7$ are independently a hydrogen or an alkyl group containing 1 to 24 carbon atoms. Preferably $R^5$ is a phenyl group substituted by $R^7$ and $R^6$ and $R^7$ are alkyl groups containing from 4 to 20 carbon atoms. In one embodiment the antioxidant can be an alkylated diphenylamine such as nonylated diphenylamine containing typically some of the formula

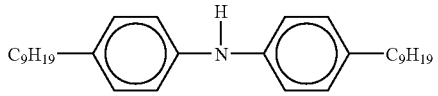

Hindered phenol antioxidants are typically alkyl phenols of the formula

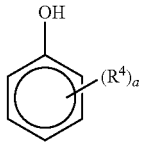

wherein $R^4$ is an alkyl group containing 1 up to 24 carbon atoms and a is an integer of 1 to 5. Preferably $R^4$ contains 4 to 18 carbon atoms and most preferably from 4 to 12 carbon atoms. $R^4$ may be either straight chained or branched chained; branched chained is generally preferred. The preferred value for a is an 1 to 4 and most preferred 1 to 3 or, particularly, 2. Preferably the phenol is a butyl substituted phenol containing 2 or 3 t-butyl groups. When a is 2, the t-butyl groups occupy the 2,6-position, that is, the phenol is sterically hindered:

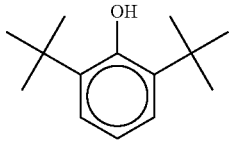

The antioxidant can be, and typically is, further substituted at the 4-position with any of a number of substituents, such as hydrocarbyl groups or groups bridging to another hindered phenolic ring.

Among the antioxidants are hindered, ester-substituted phenols such as those represented by the formula

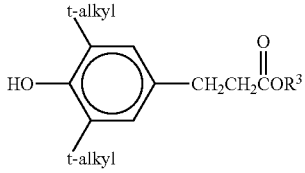

wherein t-alkyl can be, among others, t-butyl, $R^3$ is a straight chain or branched chain alkyl group containing 2 to 22 carbon atoms, preferably 2 to 8, 2 to 6, or 4 to 8 carbon atoms and more preferably 4 or 8 carbon atoms. $R^3$ is desirably a 2-ethylhexyl group or an n-butyl group. Hindered, ester-substituted phenols can be prepared by heating a 2,6-dialkylphenol with an acrylate ester under base catalysis conditions, such as aqueous KOH.

In one embodiment both a phenolic and an aromatic amine antioxidant are employed. The amount of each in a final lubricant formulation can be 0.1 to 5%, or 0.15 to 4.5%, or 0.2 to 4%, or 0.2 to 2% or 0.2 to 1%. The total amount of antioxidant can be 0.2 to 10% or to 6%, or 0.2 to 4%, or 0.3 to 9% or to 6%, or 0.4 to 8% or to 6%. In a concentrate, the amounts will be correspondingly increased by about a factor of 10.

Other conventional components may also be present in the lubricants of the present invention. Such materials include corrosion inhibitors and rust inhibitors such as various acid-containing compounds. Other optional components are extreme pressure and anti-wear agents other than those described above, which include chlorinated aliphatic hydrocarbons, boron-containing compounds including borate esters, molybdenum compounds, and zinc dithiocarbamates.

Viscosity improvers (viscosity modifiers) of various types can be present They include polyisobutenes, polymethacrylate acid esters, polyacrylate acid esters, hydrogenated diene polymers, polyalkyl styrenes, hydrogenated alkenyl aryl conjugated diene copolymers, and polyolefins. Also included are dispersant viscosity modifiers, that is, viscosity modifiers that contain polar functionality, often nitrogen-containing functionality, which imparts dispersant performance characteristics to the polymer. Known dispersant viscosity modifiers (DVMs) include those made from ethylene-propylene copolymers that have been radically grafted with maleic anhydride and reacted with various amines, including aromatic amines DVMs of this type are disclosed in, for instance, U.S. Pat. Nos.6,107,257 and 6,107,258. Other polymer backbones have also been used for preparing DVMs or other materials with dispersant properties. For example, polymers derived from isobutylene and isoprene have been used in preparing dispersants and are reported in WO 01/98387. Also, nitrogen-containing esterified carboxyl-containing interpolymers prepared from maleic anhydride and styrene-containing polymers are known from U.S. Pat. No. 6,544,935. Other DVMs include an isobutylene-diene (e.g., isoprene) copolymer having an $\overline{M}_n$ of about 1000 to about 25,000, containing thereon an average of about 0.1 to 2 units, per each 1000 units of $\overline{M}_n$ of the polymer, of groups containing carboxylic acid functionality or reactive equivalent thereof, said groups derived from at least one α,β-unsaturated carboxylic compound (e.g., maleic anhydride), reacted with an amine component comprising at least one aromatic amine containing at least one N-H group, as described in published application US-2007-0293409, Dec. 20, 2007 . Another DVM is an interpolymer of monomer-derived units of (i) at least one of an aliphatic olefin containing from 2 to 30 carbon atoms and a vinyl aromatic monomer (preferably, e.g., styrene), and (ii) at least one alpha, beta-unsaturated acylating agent (e.g., maleic anhydride); wherein a portion of said acylating agent monomers is esterified with a mixture of C4 and C8-C16 alcohols, and wherein a portion of said acylating agent monomers is condensed with at least one aromatic amine containing at least one N-H group, as described in PCT application W02005/103093, Nov. 3, 2005. Suitable aromatic amines include 4-phenylazoaniline, 4-aminodiphenylamine, 2-aminobenzimidazole, and N,N-dimethylphenyleneidamine.

The amount of a viscosity modifier contained in a fully formulated lubricant is typically 0.1 and 10% by weight, alternatively 0.5 to 6% or 1 to 3% by weight.

Pour point depressants are a particularly useful type of additive sometimes included in the lubricating oils described herein. See for example, page 8 of "Lubricant Additives" by C. V. Smalheer and R. Kennedy Smith (Lesius-Hiles Company Publishers, Cleveland, Ohio, 1967).

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

These and other additives are described in greater detail in U.S. Pat. No. 4,582,618 (column 14, line 52 through column 17, line 16, inclusive).

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Two reference examples and one example of the present invention are provided. Reference example 1 is a commercial lubricant for heavy duty diesel engines, containing a relatively high level of ZDP, sulfur, phosphorus, and ash. Reference example 2 is a formulation in which the amount of ZDP and other components is reduced in order to provide acceptably low levels of S, P, and ash. Example 1 is an example of the present invention. Amounts are listed in parts by weight, on an active chemical (oil-free) basis. The formulation of Example 1 is identical to that of Reference 2 except for the presence of the added sulfurized olefin.

| Component: | Ref. 1 | Ref. 2 | Example 1 |
|---|---|---|---|
| Base oil mixture, including viscosity modifier and pour point depressant | 87 | 87.5 | 87 |
| Succinimide dispersant(s) | 3.6 | 3.6 | 3.6 |
| Ca sulfonate detergent(s) | 1.17 | 1.39 | 1.39 |
| Sulfurized phenolic detergent(s) | 0.87 | — | — |
| Mg saligenin detergent(s) | — | 0.66 | 0.66 |
| ZDP | 1.05 | 0.46 | 0.46 |
| Phenolic and amine antioxidants | — | 0.6 | 0.6 |
| Sulfurized olefin | 0.5 | — | 0.5[a] |
| Other materials | 0.04 | 0.04 | 0.04 |
| Diluent oil including oil from components | 5.8 | 5.7 | 5.7 |
| % P in composition | 0.116 | 0.052 | 0.053 |
| % S in composition | 0.429 | 0.192 | 0.255 |
| Sulfated Ash, % (theory) | 1.2 | 1.1 | 1.1 |
| Wear (weight loss, mg) | 5.8[b] | 30.7[c] | 13.6 |

[a]The sulfurized olefin used in Example 1 is 4-carbobutoxy cyclohexane, treated with sulfur and with triphenylphosphite, 11.7% S, 0.35% P content.
[b]average of 2 measurements (5.5 and 6.1).
[c]average of 3 measurements (19.2, 30.6, and 42.2).

Also shown in the table is the wear results from the injector adjustor screw wear determined by the "Short Cummins M11 Engine Test," in mg weight loss. (The injector adjustor screw is located within the valve train assembly in the heel of the rocker arm, contacting the push tube.) This test is a modified, shortened version of the API CH-4 Cummins M11 heavy duty diesel valve train wear test. The modified test uses two stages: one stage that rapidly generates 5.5% soot and a second stage that accelerates wear.

The results show that the composition of Example 1 exhibits dramatically improved wear, compared to the identical composition in Reference 2 without the sulfurized olefin, and nearly as good wear as that of the standard, high S, high P material. Yet the amount of phosphorus in the composition is reduced by more than half, compared with the commercial material, and the amount of sulfur is reduced by 40%.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A process for lubricating a sump lubricated, compression ignited internal combustion engine, comprising supplying thereto a low-sulfur, low-phosphorus lubricant comprising:

(a) an API Group II or Group III mineral oil of lubricating viscosity;

(b) 0.2 to about 1 percent by weight of a substantially nitrogen-free sulfurized olefin antiwear agent comprising a sulfurized Diels-Alder adduct, a sulfurized aliphatic olefin containing about 12 to about 18 carbon atoms, or a sulfurized vegetable oil or lard oil, or mixtures thereof, in an amount sufficient to provide improved antiwear performance to the composition;

(c) about 2 to about 8 percent by weight of a nitrogen-containing succinimide dispersant; and (d) about 0.13 to about 2 percent by weight of an overbased calcium sulfonate detergent having a Total Base Number of at least about 300;

said lubricant formulation containing up to 0.07 percent by weight phosphorus, less than about 0.4 percent by weight sulfur, and having 0.8% to less than about 1.2% sulfated ash.

2. The process of claim 1 wherein the lubricant further comprises an overbased detergent selected from the group consisting of salixarates, saligenins, salicylates, glyoxylates, and mixtures thereof.

3. The process of claim 1 wherein the engine is a heavy-duty diesel engine.

4. A low-sulfur, low-phosphorus composition suitable for lubricating a compression ignited internal combustion engine, comprising:

(a) an API Group II or Group III mineral oil of lubricating viscosity;

(b) 0.2 to about 1 percent by weight of a substantially nitrogen-free sulfurized olefin antiwear agent comprising a sulfurized Diels-Alder adduct, a sulfurized aliphatic olefin containing about 12 to about 18 carbon atoms, or a sulfurized vegetable oil or lard oil, or mixtures thereof, in an amount sufficient to provide improved antiwear performance to the composition;

(c) about 2 to about 8 percent by weight of a nitrogen-containing succinimide dispersant;

(d) about 0.13 to about 2 percent by weight of an overbased calcium sulfonate detergent having a Total Base Number of at least about 300; and (e) an overbased detergent, selected from the group consisting of salixarates, saligenins, salicylates, glyoxylates, and mixtures thereof;

said composition containing up to 0.07 by weight phosphorus, less than about 0.4 percent by weight sulfur, and having 0.8% to less than about 1.2% sulfated ash.

5. The composition of claim 4 further comprising a zinc dialkyldithiophosphate, wherein the amount of zinc dialkyldithiophosphate is about 0.2 to about 1.2 percent by weight.

6. The composition of claim 5 wherein the alkyl groups of the zinc dialkyldithiophosphate are at least about 50% secondary alkyl groups.

7. The composition of claim 4 further comprising about 0.2 to about 6 percent by weight of an aromatic amine antioxidant or a hindered phenol antioxidant or a mixture thereof.

8. The composition of claim 7 wherein the antioxidant comprises a hindered ester-substituted phenol antioxidant.

9. The composition of claim 4 wherein the composition contains less than about 0.06 percent by weight phosphorus.

10. The composition prepared by combining the components of claim 1.

11. The composition of claim 8 wherein the hindered ester-substituted phenol antioxidant is represented by the structure

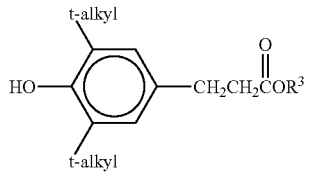

wherein $R^3$ is a straight chain or branched chain alkyl group containing 2 to 22 carbon atoms.

12. The process of claim 1 wherein the amount of the dispersant (c) is about 2.5 to about 8 weight percent.

13. The process of claim 1 wherein the substantially nitrogen-free sulfurized olefin antiwear agent comprises a sulfurized Diels-Alder adduct.

14. The composition of claim 4 wherein the substantially nitrogen-free sulfurized olefin antiwear agent comprises a sulfurized Diels-Alder adduct.

15. A process for lubricating a sump lubricated, compression ignited internal combustion engine, comprising supplying thereto a low-sulfur, low-phosphorus lubricant comprising:

(a) an API Group II mineral oil of lubricating viscosity;

(b) 0.2 to about 1 percent by weight of a substantially nitrogen-free sulfurized olefin antiwear agent comprising a sulfurized Diels-Alder adduct in an amount sufficient to provide improved antiwear performance to the composition;

(c) about 3 to about 7 percent by weight of a nitrogen-containing succinimide dispersant; and (d) about 0.13 to about 2 percent by weight of an overbased calcium sulfonate detergent having a Total Base Number of at least about 300;

said lubricant formulation containing up to 0.07 percent by weight phosphorus, less than about 0.4 percent by weight sulfur, and having 0.8% to less than about 1.2% sulfated ash.

16. The process of claim 1 wherein the amount of (c) succinimide dispersant is about 3 to about 7 percent by weight.

17. The process of claim 1 wherein the amount of the sulfurized olefin antiwear agent is 0.2 to about 0.8 weight percent.

18. The process of claim 1 wherein the amount of the sulfurized olefin antiwear agent is 0.2 to about 0.7 weight percent.

19. The composition of claim 4 wherein the amount of the sulfurized olefin antiwear agent is 0.2 to about 0.8 weight percent.

20. The composition of claim 4 wherein the amount of the sulfurized olefin antiwear agent is 0.2 to about 0.7 weight percent.

* * * * *